United States Patent [19]

Mazon, III

[11] 4,178,949

[45] Dec. 18, 1979

[54] ROTATING WEAR RINGS FOR SWIMMING POOL WHIP HOSES

[76] Inventor: Gus G. Mazon, III, 1625 Avenida De Las Americas, Tucson, Ariz. 85704

[21] Appl. No.: 909,625

[22] Filed: May 26, 1978

[51] Int. Cl.[2] ..... B08B 3/02; B08B 9/08

[52] U.S. Cl. ..... 134/167 R; 4/172; 4/172.15; 15/1.7; 138/110; 239/229

[58] Field of Search ..... 4/172, 172.15–172.17; 15/1.7; 138/110; 134/167 R, 167 C, 168 R, 168 C, 172; 239/229

[56] References Cited

U.S. PATENT DOCUMENTS

| | | | |
|---|---|---|---|
| 3,261,371 | 7/1966 | Vernon | 134/168 R |
| 3,776,464 | 12/1973 | Proffit | 239/229 |
| 3,794,052 | 2/1974 | Koble, Jr. et al. | 134/167 R |
| 3,820,172 | 6/1974 | Kane | 4/172.15 |
| 3,872,533 | 3/1975 | Proffit | 15/1.7 |

*Primary Examiner*—Robert L. Bleutge

*Attorney, Agent, or Firm*—Cahill, Sutton & Thomas

[57] ABSTRACT

A plurality of freely rotating wear rings are disposed along a flexible whip hose of the type used for cleaning swimming pools. The rotating wear rings prevent the flexible whip hose from being abraded by the inner surfaces of a swimming pool. The rotating wear rings have long lives, as their rotation precludes significant abrasion upon the inner surfaces of the swimming pool.

9 Claims, 3 Drawing Figures

ROTATING WEAR RINGS FOR SWIMMING POOL WHIP HOSES

BACKGROUND OF THE INVENTION

1. Field of the Invention

The invention is related to swimming pool cleaning apparatus and, more particularly, to wear rings for use on flexible swimming pool whip hoses.

2. Description of the Prior Art

Numerous devices are known for removing sediment and suspended particulate matter from swimming pools. Manually operated vacuuming devices are commonly used, but the use of such devices requires considerable manual labor. Further, such devices are rather ineffective because their utilization "stirs up" a considerable amount of sediment, which resettles before it can be removed by a recirculating filtration system. Pressurized flexible "whip hoses" are commonly utilized to eject high velocity jets of water randomly along inner surfaces of a swimming pool to keep particulate matter in suspension so the filtration system can remove the particulate matter. Various systems have been utilized to control the sinuous whipping action of whip hoses, including positioning variously spaced buoys and weights along the flexible whip hoses. An early but unsuccessful approach for controlling a nozzle end of a flexible whip hose is described in U.S. Pat. No. 3,108,298 (Gelinas), wherein a nozzle end of the whip hose is supported on a planchette device mounted on several casters and propelled in a random pattern along the bottom of a swimming pool by thrust produced by high velocity expulsion of water through the whip hose nozzle. To avoid abrading of flexible whip hoses and also to control their whipping action, plastic wear rings have been concentrically disposed along whip hoses, as described in U.S. Pat. No. 3,794,052 (Koble et al) and U.S. Pat. No. 3,820,172 (Kane). Such wear rings support the whip hoses so that the whip hoses do not contact the inner surfaces of the swimming pool during their random whip-like movement along the inner surfaces. However, the known wear rings themselves are abraded considerably by the inner surfaces of the swimming pool and therefore must be periodically replaced. The known wear rings also cause damage to the finish of the interior pool surface. Other known devices representative of the state of the art are disclosed in the following U.S. Pat. Nos.: 3,521,304; 3,575,729; 3,585,654; 3,433,237; 3,269,421; 3,139,009; 3,170,180; 3,108,298; 3,078,998; 3,032,044; and 2,982,971. However, none of the disclosed prior wear ring devices are both reliable and essentially maintenance-free.

SUMMARY OF THE INVENTION

Accordingly, it is an object of the invention to provide a maintenance-free swimming pool cleaning apparatus.

It is another object of the invention to provide abrasion reduced swimming pool whip hose systems.

It is yet another object of the invention to provide a rotatable whip hose wear ring device.

It is yet another object of the invention to provide a rotatable whip hose wear ring device which is less abraded by swimming pool surfaces than prior whip hose wear rings.

Briefly described, and in accordance with one embodiment thereof, the invention provides a rotating wear ring device for flexible whip hoses useful in swimming pool cleaning systems. A plurality of rotating wear ring devices are disposed in spaced relationship along a whip hose to prevent the whip hose from being abraded by the swimming pool surface as the whip hose continuously and randomly traverses the inner swimming pool surfaces. The rotating wear ring devices further act to control the whipping action of the whip hose. The rotating wear ring device includes a ring or collar concentrically rotatably disposed on a tubular bearing. The tubular bearing is concentrically disposed on the whip hose. The tubular bearing has an inside diameter selected to permit the tubular bearing to frictionally engage the whip hose. Retainers are included at each end of the tubular bearing to retain the collar thereon. The outside diameter of the tubular bearing is less than the inside diameter of the collar by a predetermined tolerance selected to permit reliable rotation of the collar on the outer surface of the tubular bearing as the whip hose continuously transverses the inner surfaces of the swimming pool.

In one embodiment of the invention, the tubular bearing includes two symmetric half-sections each having a retainer at one end. Each rotating wear ring device is installed on the whip hose by sliding one of the half-sections over the whip hose to a desired point thereof, sliding the collar over the whip hose and over the outer surface of the first half-section. The second half section is then slid over the whip hose so that the second half-section abuts the first half-section. The collar can thus rotate freely on the outer surfaces of both half-sections, and is retained by the retainers of the respective half-sections.

In another embodiment of the invention, the opposed ends of the collar are tapered to reduce axial components of friction as the collar is both axially and transversely moved along a swimming pool bottom by the whip-like action of a whip hose.

In yet another embodiment of the invention, an end rotating wear ring device includes a retaining element incorporating a whip hose nozzle. In this embodiment, a collar is rotatably disposed on a bearing half-section concentrically disposed on the nozzle end of the whip hose, a first end of the bearing half-section being aligned with the nozzle end of the whip hose and a second end having a first retainer thereat. A second retainer incorporating a whip hose nozzle is inserted or threaded into the nozzle end of the whip hose and abutts the first end of the bearing half-section, thereby retaining the end collar on the bearing half-section.

DESCRIPTION OF THE INVENTION

Figure 1:
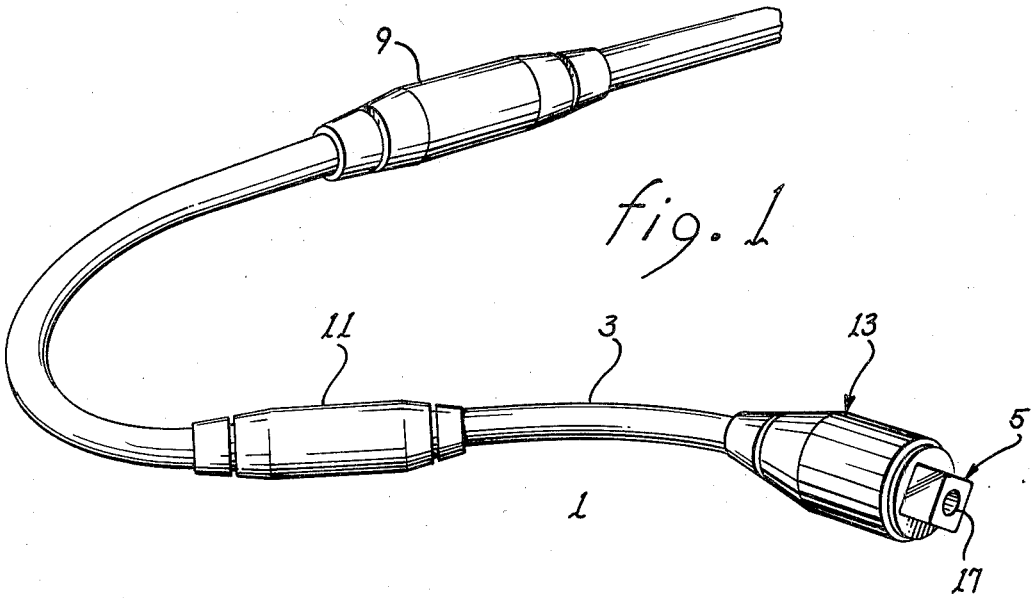
FIG. 1 is a partial perspective view of a whip hose assembly incorporating the rotating wear ring devices of the invention.

Referring now to FIG. 1, the illustrated embodiment of the invention includes a whip hose assembly 1 for use in conjunction with a swimming pool cleaning system. Whip hose assembly 1 includes a flexible whip hose 3 having first and second rotating wear ring devices 9 and 11 concentrically mounted at spaced points along whip hose 3. A nozzle element 5 is attached to one end of whip hose 3. Nozzle element 5 includes a nozzle aperture 7 through which high pressure water in flexible hose 3 is ejected to stir up sedimentary particulate matter which has settled along the bottom of a swimming pool, thereby keeping the suspended particulate matter in suspension so that it can be removed by a filtration system. The environment of the invention, namely, swimming pools having swimming pool cleaning systems incorporating flexible whip hoses of the type utilizing wear rings concentrically positioned along such whip hoses, is set forth in U.S. Pat. No. 3,820,172, issued to Robert J. Kane, on June 28, 1974, and incorporated herein by reference.

Figure 2:
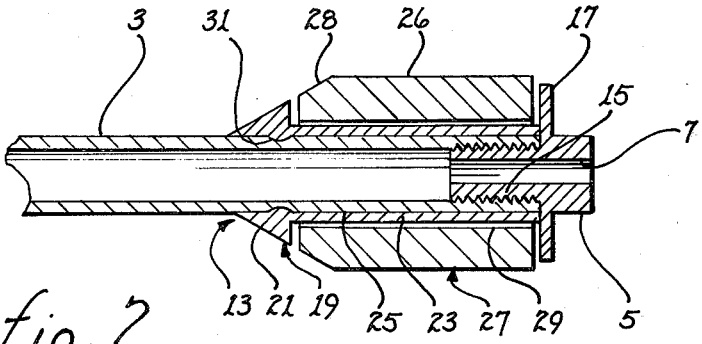
FIG. 2 is a section view of the end rotating collar wear ring device of FIG. 1.

In FIG. 2, a rotating wear ring device 13 is especially adapted for use on the nozzle end of whip hose 3 is shown. Rotating collar 27 of wear ring device 13 has a cylindrical outer surface 26, a concentric inner cylindrical bearing surface 29 and a tapered surface 28. Rotating collar 27 is concentrically disposed about tubular bearing 19. Bearing 19 includes a cylindrical shaft portion 23 concentrically disposed on and frictionally engaged to the outer surface of whip hose 3. Ring-shaped detent 31 is formed on the inner cylindrical surface 25 of bearing 19 to improve the frictional engagement of bearing 19 with the outer surface of whip hose 3 to prevent axial displacement of rotating wear ring device 13 along whip hose 3. Bearing 19 further includes a retaining flange 21 for preventing rotating collar 27 from sliding off bearing 19 during rotation.

Still referring to FIG. 2, nozzle element 5 includes flange 17 and threaded shaft 15 through which nozzle aperture 7 extends. Nozzle element 5 is threaded into the nozzle end opening of whip hose 3 until the inner face of flange 17 abuts the outer end of cylindrical shaft 23 of bearing 19. Flange 17 thereby serves as a retainer to prevent rotating collar 27 from sliding off the outer end of shaft 23 during rotation of collar 27. Nozzle element 5 has a square head (as can be seen in FIG. 1) to facilitate threading of nozzle element 5 into the open end of flexible hose 3.

Figure 3:
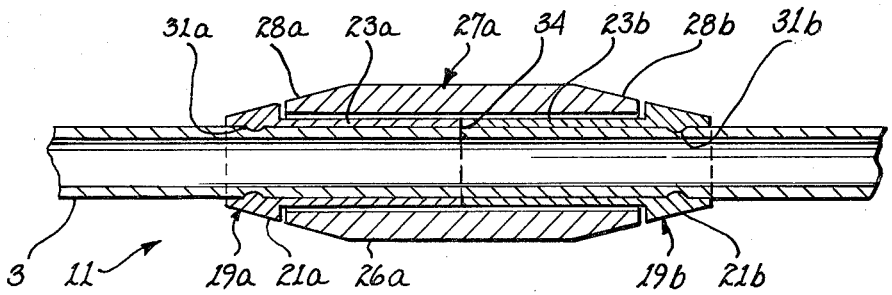
FIG. 3 is a sectional view of an intermediate rotating wear ring device of FIG. 1.

Referring now to FIG. 3, intermediate rotating wear ring device 11 includes rotating collar 27A which has a cylindrical surface 26A and tapered surfaces 28A and 28B at its opposed ends. Tapered surfaces 28A and 28B are provided to reduce an axial component of frictional force as rotating collar 27A is both axially and transversely moved along a swimming pool bottom by sinuous whip-like action of whip hose assembly 1. Rotating collar 27A is concentrically disposed on a bearing including two half-sections 19A and 19B. Half-sections 19A and 19B are substantially identical devices symmetrically disposed along whip hose 3. Half-sections 19A and 19B are similar or identical in structure to bearing 19 of FIG. 2. It should be noted that corresponding reference numerals are utilized in FIG. 3 to designate corresponding parts of half-sections 19A and 19B, respectively. Bearing half-section 19A includes a cylindrical bearing shaft 23A and a retaining flange 21A similar or identical to bearing shaft 23 and retaining flange 21, respectively, of FIG. 2. Detent ridge 31A in FIG. 3 is similar to detent ridge 31 in FIG. 2.

The symmetric structure of bearing half-sections 19A and 19B of FIG. 3 facilitates assembly of intermediate rotating wear ring devices such as 9 and 11. To install rotating wear ring device 11 on whip hose 3, half-section 19A is concentrically slid along whip hose 3 to a desired point thereof, as shown in FIG. 3. Rotating collar 27A is then concentrically slid along whip hose 3 and onto shaft 23A of half-section 19A. Half-section 19B is then slid concentrically along whip hose 3 until the inner end of concentric shaft 23B abutts the inner end of shaft 23A, as shown in FIG. 3. The longitudinal dimensions are such that flanges 21A and 21B are spaced from the ends of rotating collar 27A by a predetermined tolerance to permit suitable freedom of rotation of collar 27A about the composite bearing formed by half-sections 19A and 19B.

In one embodiment of the invention, rotating collar 27, bearing 19, and nozzle element 5 are all composed of nylon. The outside diameter of rotating collar 27 is approximately 0.7 inches. The tolerance between the inner cylindrical surface 29 of rotating collar 27 and the outside diameter of bearing shaft 23 is approximately 20 mils. This tolerance has been found to be adequate to permit suitable rotation of collar 27 about bearing 19 under normal conditions. Rotating collar 27A and half-sections 19A and 19B of FIG. 3 are formed of nylon. The radial dimensions of rotating collar 27A and bearing 19A can be equal to the corresponding radial dimensions of the elements of FIG. 2.

The rotating wear ring devices are spaced along the whip hose so as to prevent the whip hose from being abraded by the inner pool surface and to control the sinuous whip-like action of the whip hose to optimize cleaning action thereof.

The foregoing whip hose assembly is essentially maintenance-free. Since the rotating wear ring devices of the invention are formed of inexpensive nylon, their cost is only slightly greater than the cost of the wear rings of the prior art. Yet, the rotating wear ring devices of the present invention have a far longer life than the prior art wear rings, which may have to be replaced as often as once each swimming season.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A rotational device for use on a flexible whip hose for cleaning a swimming pool, said rotational device comprising in combination:

(a) rotating means concentrically disposed about said flexible whip hose for rolling along interior surfaces of the swimming pool while supporting said flexible whip hose to prevent abrading of said flexible whip hose by the interior surfaces, said rotating means including a cylindrical collar having at least one tapered end; and (b) bearing means concentrically disposed on and frictionally engaging said flexible whip hose for axially and rotatably supporting said rotating means, said bearing means including a first cylindrical tubular shaft concentrically disposed about and frictionally engaging said flexible whip hose and having an outside diameter less than the inside diameter of said cylindrical collar, the difference between said outside diameter and said inside diameter being a predetermined tolerance dimension selected to permit substantially free rotation of said cylindrical collar about said first cylindrical tubular shaft.

2. The rotational device of claim 1 wherein said bearing means further includes first retaining means disposed at one end of said first cylindrical tubular shaft for preventing said cylindrical collar from sliding off said first cylindrical tubular shaft.

3. The rotational device of claim 2 wherein said first retaining means is integral with one end of said first cylindrical tubular shaft.

4. The rotational device of claim 3 wherein said bearing means further includes a second cylindrical tubular shaft substantially identical to said first cylindrical shaft and having said second retaining means integral therewith, said second cylindrical tubular shaft being concentrically disposed on and frictionally engaged to said flexible whip hose to further axially and rotatably support said cylindrical collar.

5. The rotational device of claim 3 wherein said bearing means and said rotating means are composed of nylon.

6. The rotational device of claim 2 further including second retaining means for preventing said cylindrical collar from sliding off said first cylindrical tubular shaft, said second retaining means including a nozzle for said flexible whip hose.

7. A rotational device for use on a flexible whip hose for cleaning a swimming pool, said rotational device comprising in combination:

(a) rotating means concentrically disposed about said flexible whip hose for rolling along interior surfaces of the swimming pool while supporting said flexible whip hose to prevent abrading of said flexible whip hose by the interior surfaces; and (b) bearing means concentrically disposed on and frictionally engaging said flexible whip hose for axially and rotatably supporting said rotating means, said bearing means including an interior detent for increasing the frictional engagement of said flexible whip hose.

8. A whip hose assembly for use in conjunction with swimming pool cleaning systems, said whip hose assembly comprising in combination:

(a) a flexible whip hose; and (b) a plurality of rotational wear ring devices disposed in spaced relationship along said flexible whip hose, each of said rotational wear ring devices including i. rotating means concentrically disposed about said flexible whip hose for rolling along interior surfaces of the swimming pool while supporting said flexible whip hose to prevent abrading of said flexible whip hose by the interior surfaces; and ii. bearing means concentrically disposed on and frictionally engaged to said flexible whip hose for axially and rotatably supporting said rotating means.

9. A rotational device for use on a flexible whip hose for cleaning a swimming pool, said rotational device comprising in combination:

(a) rotating means concentrically disposed about said flexible whip hose for rolling along interior surfaces of the swimming pool while supporting said flexible whip hose to prevent abrading of said flexible whip hose by the interior surfaces; and (b) bearing means concentrically disposed on and frictionally engaging said flexible whip hose for axially and rotatably supporting said rotating means, said bearing means including a first cylindrical tubular shaft concentrically disposed about and frictionally engaging said flexible whip hose and having an outside diameter less than the inside diameter of said cylindrical collar, the difference between said outside diameter and said inside diameter being a predetermined tolerance dimension selected to permit substantially free rotation of said cylindrical collar about said first cylindrical tubular shaft.

* * * * *